US008602236B2

(12) United States Patent
Herbst

(10) Patent No.: US 8,602,236 B2
(45) Date of Patent: Dec. 10, 2013

(54) BOTTLE INCLUDING A BASE PORTION AND A HOLLOW CLOSURE FOR REMOVABLY SEALING THE BASE PORTION

(75) Inventor: Andrew F. Herbst, Copperopolis, CA (US)

(73) Assignee: RNR IP Holdings, LLC, Stockton, CA (US)

( * ) Notice: Subject to any disclaimer, the term of this patent is extended or adjusted under 35 U.S.C. 154(b) by 47 days.

(21) Appl. No.: 13/289,484

(22) Filed: Nov. 4, 2011

(65) Prior Publication Data

US 2013/0112649 A1 May 9, 2013

(51) Int. Cl.
*B65D 39/00* (2006.01)

(52) U.S. Cl.
USPC ..... 215/355; 222/569; 220/254.1; 220/254.9; 220/255

(58) Field of Classification Search
USPC ..... 220/212, 254.1, 255, 254.9; 215/228, 215/355, 364; 222/464.1, 569
See application file for complete search history.

(56) References Cited

U.S. PATENT DOCUMENTS

| | | | | |
|---|---|---|---|---|
| 47,238 | A | 4/1865 | Whitall | |
| 3,326,400 | A | 6/1967 | Hamelin et al. | |
| 3,720,524 | A * | 3/1973 | Nakagami | 426/115 |
| D440,487 | S | 4/2001 | Leach | |
| 6,472,007 | B2 | 10/2002 | Bezek et al. | |
| 7,055,709 | B1 | 6/2006 | Esau | |
| 7,568,576 | B2 * | 8/2009 | Sweeney et al. | 206/219 |
| 7,604,138 | B2 | 10/2009 | Seher et al. | |
| 7,635,012 | B2 | 12/2009 | Johns et al. | |
| 7,909,160 | B2 | 3/2011 | Patterson et al. | |
| 2002/0166835 | A1 | 11/2002 | Carter | |
| 2003/0072850 | A1 | 4/2003 | Burniski | |
| 2003/0152672 | A1 | 8/2003 | Coleman et al. | |
| 2005/0184024 | A1 | 8/2005 | Santa Cruz et al. | |
| 2005/0184026 | A1 | 8/2005 | Haley | |
| 2006/0070971 | A1 | 4/2006 | Michalopoulos | |
| 2006/0151414 | A1 | 7/2006 | Mullen | |
| 2007/0079895 | A1 | 4/2007 | Jeng | |
| 2008/0202950 | A1 | 8/2008 | Anderson | |
| 2008/0245683 | A1 | 10/2008 | McKenna et al. | |
| 2009/0008355 | A1 | 1/2009 | Karabin | |
| 2010/0163509 | A1 | 7/2010 | Canziani Hoffa et al. | |
| 2010/0294739 | A1 | 11/2010 | Morris, III et al. | |
| 2011/0031208 | A1 | 2/2011 | Golden | |
| 2011/0049081 | A1 | 3/2011 | Bourguignon | |
| 2011/0174642 | A1 | 7/2011 | Coon | |

FOREIGN PATENT DOCUMENTS

| | | | |
|---|---|---|---|
| EP | 2110332 | A1 | 10/2009 |
| JP | 07-330041 | A | 12/1995 |

OTHER PUBLICATIONS

International Search Report and Written Opinion dated Mar. 28, 2013, as issued incorresponding International Patent Application No. PCT/US2012/063548 (10 pgs.).

* cited by examiner

*Primary Examiner* — David Fidei
*Assistant Examiner* — Raven Collins
(74) *Attorney, Agent, or Firm* — Maier & Maier, PLLC

(57) ABSTRACT

A bottle including a hollow removable closure. The bottle can include a base portion enclosing a substantially hollow interior, the base portion including a mouth in fluid communication with the interior, a removable closure enclosing a substantially hollow reservoir, the removable closure including an opening in fluid communication with the reservoir and a stopper removably sealing the opening, wherein a portion of the closure is receivable within the mouth of the base portion such that the opening of the closure is received through the mouth and a liquid-tight seal is formed between the base portion and a portion of the closure.

14 Claims, 3 Drawing Sheets

BOTTLE INCLUDING A BASE PORTION AND A HOLLOW CLOSURE FOR REMOVABLY SEALING THE BASE PORTION

BACKGROUND

Bottles are ubiquitously used as vessels for storing and transporting liquids. The bottles commonly include a single interior chamber for storing a single type of liquid, and are typically provided with seals such as corks, stoppers, caps, or the like so as to maintain the liquid within the bottle. Such seals are predominantly utilitarian and do not provide chambers for separate storage of additional liquids.

SUMMARY

According to at least one exemplary embodiment, a bottle including a hollow removable closure is disclosed. The bottle can include a base portion enclosing a substantially hollow interior and a removable closure enclosing a substantially hollow reservoir. The base portion can include a mouth in fluid communication with the interior, and the removable closure can include an opening in fluid communication with the reservoir and a stopper removably sealing the opening. A portion of the closure can be receivable within the mouth of the base portion such that the opening of the closure is received through the mouth and a liquid-tight seal is formed between the base portion and a portion of the closure.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Figure 1A:
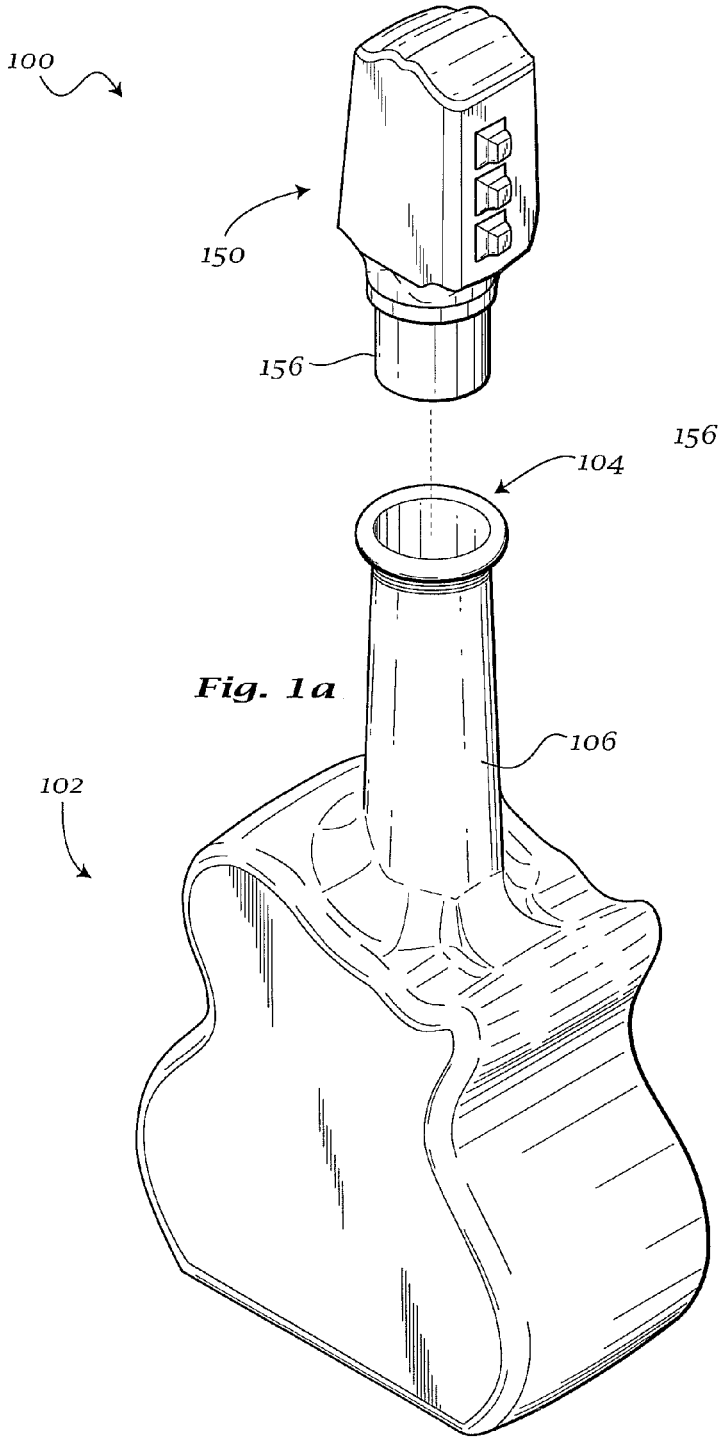
FIG. 1*a* is an isometric view of an exemplary embodiment of a bottle including a hollow removable closure.
Figure 1B:
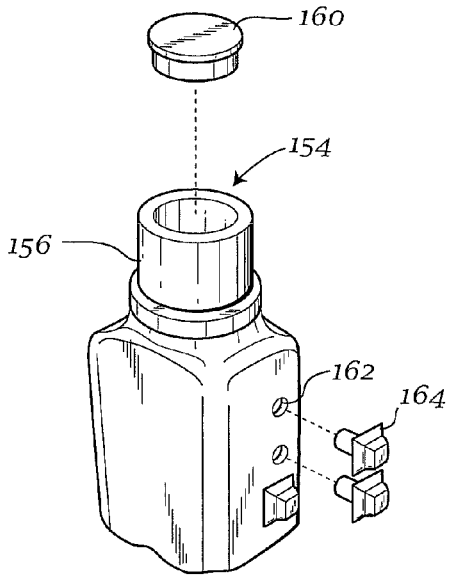
FIG. 1*b* is an isometric view of an exemplary embodiment of a hollow removable closure for a bottle.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Generally referring to FIGS. 1*a*-3, a bottle, or any other type of container or containment vessel, having a hollow closure 100 may be disclosed. Bottle 100 may include a base portion 102 and a hollow closure 150. Bottle 100 may be formed from any suitable material or combination of materials, for example glass, plastic, metal, and so forth. Bottle 100 may further have any desired shape, which may be a decorative or novelty shape. In the illustrated embodiment, bottle 100 may be shaped as a musical instrument, for example a guitar; however, any shape that enables bottle 100 to function as described herein may be contemplated and provided as desired. Bottle 100, or any portion thereof, may also be transparent, translucent, or opaque. Hollow closure 150 may be fully separable from base portion 102, or may be partially separable and coupled to base portion 102 by way of hinges, joints, or any other suitable coupling.

Base portion 102 may include a substantially hollow interior 103 wherein a liquid may be disposed, for example a potable liquid such as liquor, or any other desired liquid or matter with liquid or fluid traits. Thus, it is envisioned that any type of material, solid, liquid, or gas, may be housed in bottle 100. For example, solid materials such as, but not limited to, sand, pieces of candy and the like may be housed within bottle 100 as desired. Base portion 102 may further include a mouth 104 through which the liquid may be input or withdrawn. In some embodiments, base portion 102 may include a neck 106, with mouth 104 being disposed at an end of neck 106.

Hollow closure 150 may include a reservoir 152 and a neck 156. Both reservoir 152 and neck 156 may be substantially hollow and in communication with each other, and any desired liquid may be disposed within the reservoir and neck of hollow closure 150. The liquid disposed within hollow closure 150, may also be a potable liquid, and may be diverse from the liquid disposed within base portion 102. Alternatively, any other material, solid, liquid or gas, may be housed in hollow closure, as desired. Hollow closure 150 may further include an opening 154 through which the liquid may be input or withdrawn. In some embodiments, opening 154 may be disposed at an end of neck 156.

Figure 2A:
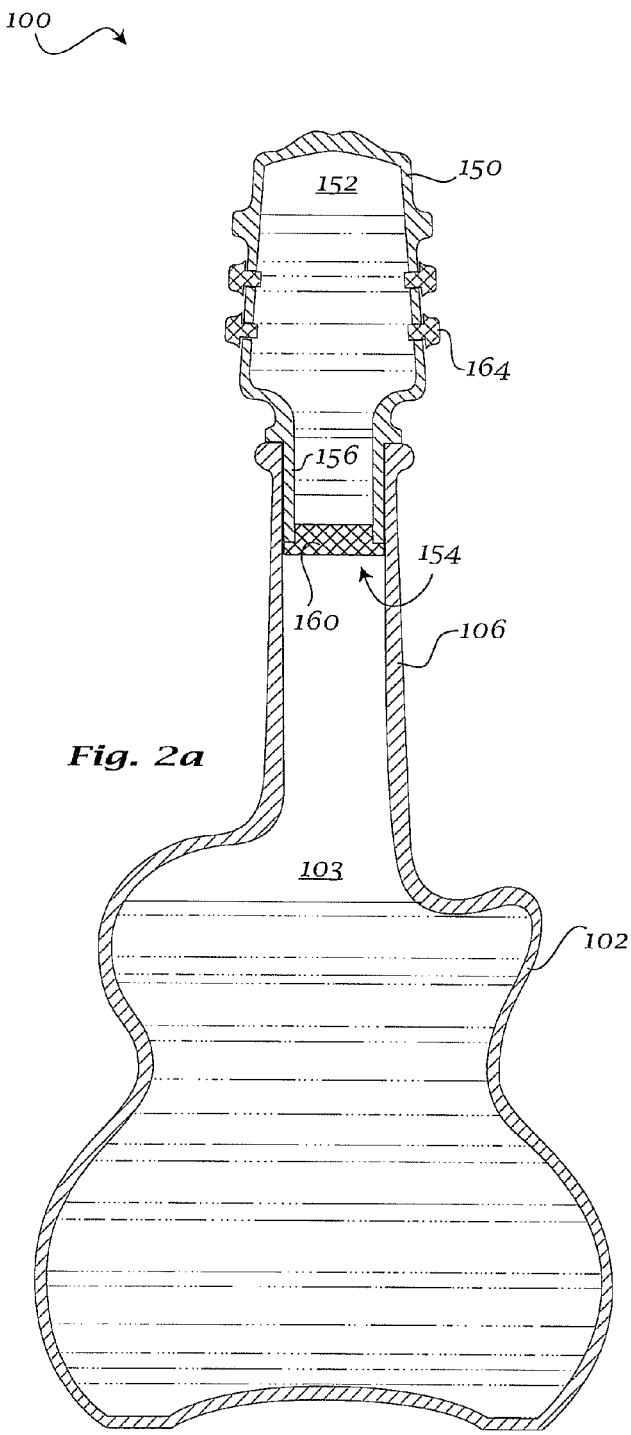
FIG. 2*a* is an cross-sectional view of an exemplary embodiment of a bottle including a hollow removable closure.
Figure 2B:
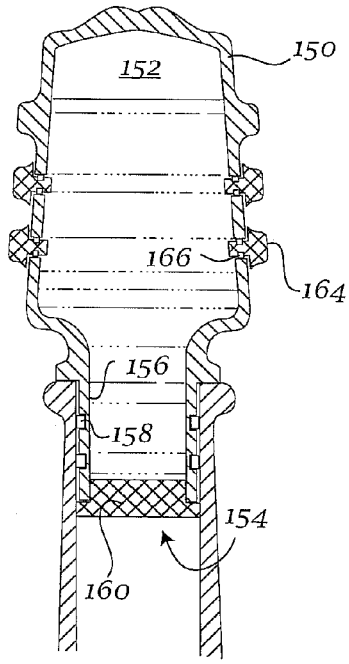
FIG. 2*b* is a partial cross-sectional view of another exemplary embodiment of a bottle including a hollow removable closure.

Neck 156 of hollow closure 150 may be sized and shaped to fit within mouth 104 of base portion 102. To that end, the outer perimeter of neck 156 may be substantially similar to the inner perimeter of mouth 104. In some exemplary embodiments, a liquid-tight seal or a gas-tight seal, for example, via a friction coupling, may be created between neck 156 and mouth 104 when neck 156 is disposed within mouth 104, as shown in FIG. 2*a*. In other exemplary embodiments, sealing elements 158, such as sealing rings or the like may also be provided to form or enhance the liquid-tight seal, as shown in FIG. 2*b*. Such sealing elements may be disposed within mouth 104, around neck 156, or both, and may be formed from any suitable material, for example rubber, plastic, polymeric material, or the like. In some exemplary embodiments, neck 156 and mouth 104 may be threaded, so as to create a seal by threaded engagement between neck 156 and mouth 104.

As shown in FIGS. 2*a*-2*b*, opening 154 of neck 156 may also include a stopper 160. Stopper 160 may be any suitable type of seal, for example a stopper, bung, cap, cork, or the like, and may be formed from any suitable material. Removable seal 160 may also be sized and shaped to fit within the inner perimeter of opening 154 of neck 156 or may be disposed around the outer perimeter of neck 156. In some exemplary embodiments, a liquid-tight seal, for example, via a friction coupling, may be created between neck 156 and stopper 160. In other exemplary embodiments, stopper 160 and neck 156 may be threaded so as to create a seal by threaded engagement between neck 156 and stopper 160.

In some exemplary embodiments, hollow closure 150 may include secondary openings 162 in the surface thereof, the secondary openings being in communication with reservoir 152. Secondary openings 162 may also be provided with secondary stoppers 164. Secondary stoppers 164 may be any suitable type of seal, for example a stopper, bung, cap, cork, or the like, or a combination thereof, and may be formed from any suitable material. Secondary openings 162 may provide alternative paths for emptying or filling hollow closure 150 with liquid. In some exemplary embodiments, secondary stoppers 164 may be formed as decorative or simulative elements as part of the overall design of hollow closure 150. Secondary stoppers 164 may alternatively be formed from any desired material, for example the material of bottle 100, base 102 or closure 150, and additional sealing elements 166, such as sealing rings or the like may be provided to form or enhance the liquid-tight seal between secondary openings 162 and secondary stoppers 164.

Figure 2C:
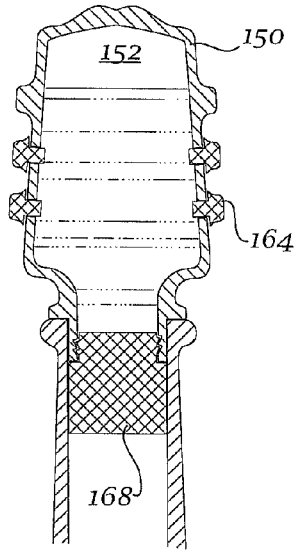
FIG. 2*c* is a partial cross-sectional view of another exemplary embodiment of a bottle including a hollow removable closure.

In another exemplary embodiment, as shown in FIG. 2*c*, a dual stopper 168 may facilitate sealing both mouth 104 and opening 154 of hollow closure 150. To that end, dual stopper 168 may be removably coupled both to mouth 104 and neck 156 such that the removable coupling between dual stopper 168 and opening 154 is stronger than the removable coupling between dual stopper 168 and mouth 104. Hollow closure 150 and dual stopper 168 can therefore be removed from mouth 104 without disturbing the coupling between dual stopper 168 and opening 154; dual stopper 168 can subsequently be decoupled from opening 154. To that end, as a non-limiting example, the coupling between dual stopper 168 and mouth 104, may be a friction coupling, while the coupling between dual stopper 168 and opening 154 may be a threaded coupling.

In operation, the user may separate hollow closure 150 from base portion 102 so as to allow the liquid disposed within base portion 102 to be withdrawn via mouth 104, or for a liquid to be input into base portion 102. Subsequently, the user may withdraw stopper 160 from opening 154 of hollow closure 150, so as to allow the liquid disposed within hollow closure 150 to be withdrawn, or for a liquid to be input into reservoir 152 of hollow closure 150. The user may also remove secondary seals 164 from secondary openings 162 so as to provide an alternate path for the transfer of liquid into or out of hollow closure 150.

Figure 3:
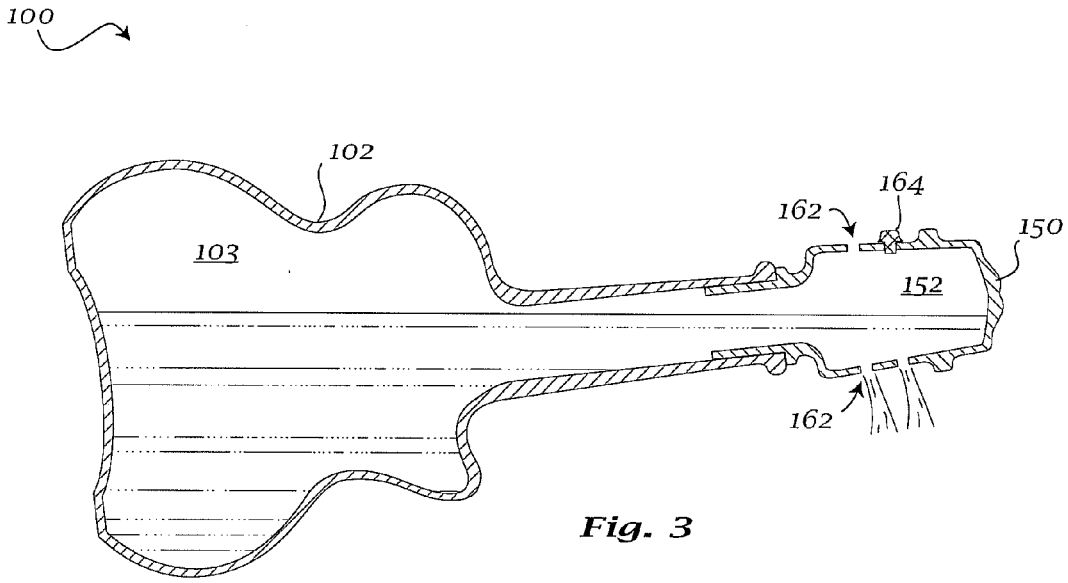
FIG. 3 is a cross-sectional view of an exemplary embodiment of a bottle including a hollow removable closure with the stopper removed.

In some exemplary embodiments, hollow closure 150 may be disposed within mouth 104 of base portion 102 with the stopper 160 absent from opening 154 of hollow closure 150. In such an arrangement, the interior 103 of base portion 102 may be in fluid communication with reservoir 152 of hollow closure 150, with the liquid-tight seal between neck 156 and mouth 104 being maintained. As shown in FIG. 3, the user may then utilize secondary openings 162 to transfer liquid into or out of both reservoir 152 and interior 103 of base portion 102. Secondary openings 162 may also be utilized to provide a passage for air so as to equalize air pressure within bottle 100 during the pouring of liquid therefrom.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A bottle including a hollow removable closure, comprising:

a base portion enclosing a substantially hollow interior, the base portion comprising a mouth in fluid communication with the interior;

a removable closure enclosing a substantially hollow reservoir, the removable closure comprising an opening in fluid communication with the reservoir and a stopper removably sealing the opening;

wherein a portion of the closure is receivable within the mouth of the base portion such that the opening of the closure is received through the mouth and a liquid-tight seal is formed between the base portion and a portion of the closure;

the closure further comprising at least one secondary opening and a secondary stopper removably sealing the at least one secondary opening.

2. The bottle of claim 1, wherein, when the stopper is removed from the opening of the closure and a portion of the closure is disposed within the mouth of the base portion, the interior of the base portion is in fluid communication with the reservoir of the closure.

3. The bottle of claim 1, wherein, when the stopper is removed from the opening of the closure and a portion of the closure is disposed within the mouth of the base portion, the interior of the base portion is in fluid communication with the reservoir of the closure and the at least one secondary opening.

4. The bottle of claim 1, wherein a liquid-tight seal is formed between the base portion and the stopper.

5. The bottle of claim 1, wherein the bottle is formed in the shape of a musical instrument.

6. The bottle of claim 1, wherein the bottle is formed in the shape of a guitar.

7. A bottle including a hollow removable closure, comprising:

a base portion enclosing a substantially hollow interior, the base portion comprising a first substantially hollow neck in fluid communication with the interior and a mouth disposed at a distal end of the first neck;

a removable closure enclosing a substantially hollow reservoir, the removable closure comprising a second substantially hollow neck in fluid communication with the reservoir, an opening disposed at a distal end of the second neck, and a stopper removably sealing the opening, the removable closure further comprising at least one secondary opening and a secondary stopper removably sealing the at least one secondary opening;

wherein the distal end of the second neck is received within the distal end of the first neck.

8. The bottle of claim 7, wherein a liquid-tight seal is formed between the first neck and the second neck.

9. The bottle of claim 7, wherein a liquid-tight seal is formed between the first neck and the stopper.

10. The bottle of claim 7, wherein, when the stopper is removed from the opening of the second neck and the second neck is disposed within the first neck, the interior of the base portion is in fluid communication with the reservoir of the closure.

11. The bottle of claim 7, wherein, when the stopper is removed from the opening of the second neck and the second neck is disposed within the first neck, the interior of the base portion is in fluid communication with the reservoir of the closure and the at least one secondary opening.

12. The bottle of claim 7, wherein the bottle is formed in the shape of a musical instrument.

13. The bottle of claim 7, wherein the bottle is formed in the shape of a guitar.

14. The bottle of claim 1, wherein:

the closure further comprises a substantially hollow neck in fluid communication with the reservoir, the neck sized and shaped to be receivable within the mouth of the base portion such that a liquid-tight seal is formed between the base portion and the neck; and wherein the opening is disposed at en end of the neck.

* * * * *